US006318254B1

(12) United States Patent
Saitoh et al.

(10) Patent No.: US 6,318,254 B1
(45) Date of Patent: Nov. 20, 2001

(54) STENCIL PRINTING MACHINE HAVING STATIC ELECTRICITY DISCHARGING MEMBERS

(75) Inventors: Takeshi Saitoh; Toshimitsu Sakai, both of Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/531,887

(22) Filed: Mar. 21, 2000

(30) Foreign Application Priority Data

Apr. 1, 1999 (JP) ..... 11-095027

(51) Int. Cl.[7] ..... B41L 13/04; B41C 1/14
(52) U.S. Cl. ..... 101/116; 101/128.4; 400/120.18
(58) Field of Search ..... 101/114, 116, 101/117, 118, 128.4, 129, 121, 127; 400/120.01, 120.02, 120.18; 347/222, 212

(56) References Cited

U.S. PATENT DOCUMENTS 5,513,919 * 5/1996 Hevenor ..... 400/120.02
5,970,869 * 10/1999 Hara et al. ..... 101/128.4
6,050,184 * 4/2000 Kidoura et al. ..... 101/128.4

* cited by examiner

*Primary Examiner*—Leslie J. Grohusky
(74) *Attorney, Agent, or Firm*—Kanesaka & Takeuchi

(57) ABSTRACT

A stencil printing machine includes a thermal head for perforating a stencil sheet; a platen roller situated adjacent to the thermal head, the platen roller conveying the stencil sheet in a predetermined direction while holding the stencil sheet in contact with the thermal head; a printing drum situated near the thermal head and the platen roller, the printing drum being adapted to receive the stencil sheet perforated by the thermal head and the platen roller; and a discharging member situated near the platen roller on a downstream side of the predetermined direction relative to the thermal head and the platen roller, the discharging member discharging static electricity charged on the stencil sheet.

5 Claims, 2 Drawing Sheets

STENCIL PRINTING MACHINE HAVING STATIC ELECTRICITY DISCHARGING MEMBERS

BACKGROUND OF THE INVENTION

1. Field of the Invention

The present invention relates to a stencil printing machine in which a stencil sheet is perforated by a thermal head and a platen roller and then wound around a printing drum for stencil printing.

2. Description of the Related Art

FIG. 2 is a sectional view showing a part of a stencil printing machine where a stencil sheet is used.

The stencil sheet 100 in a roll is perforated by a thermal head 101 and a platen roller 102 of a perforating section while being pinched and conveyed therebetween. The stencil sheet is conveyed by conveying rollers 103 into a storing section 104 and stored therein. While a used stencil sheet wound around the printing drum 105 is discharged, the stencil sheet in a length to be used for one printing-operation is previously perforated and stored in the storing section 104. The stencil sheet 100 previously perforated is fed out by rollers 106 in a predetermined timing and conveyed to the printing drum 105. A leading end of the stencil sheet 100 is held on the printing drum 105 by a clamp plate 107, and the sheet is wound around the printing drum by rotating the printing drum. Then, the stencil sheet 100 is cut by a cutter 108 in the length for one printing-operation. Nest,a printing sheet is fed between the printing drum 105 and a pressing roller 109 in synchronization with rotation of the printing drum 105 and upward movement of the pressing roller 109. The printing sheet is printed while being pinched and conveyed between the printing drum 105 and the pressing roller 109.

The stencil sheet is composed of a thermoplastic synthetic resin film such as a plastic film, and a porous substrate laminated with the film. As the porous substrate, there can be mentioned porous thin paper such as Tengujo-type Japanese paper, porous sheet made from synthetic fibers, woven fabric, and non-woven fabric. The stencil sheet is normally conveyed by the perforating section in such a manner that the thermal head 101 contacts the thermoplastic synthetic resin film and the platen roller 102 contacts the porous substrate.

The stencil sheet is charged with static electricity while being pinched and perforated by the thermal head and the platen roller. That is, high nip pressure is exerted on the stencil sheet by the thermal head and the platen roller, so that the stencil sheet is conveyed in forceful contact with the thermal head and the platen roller during perforating. Therefore, the static electricity charge is inevitable.

Thus, a problem arises as shown in FIG. 2. Namely, the stencil sheet 100 sticks to a circumferential surface of the platen roller 102. Additionally, the stencil sheet 100 is distorted in a twisting way in the storing section 104 by the static electricity. If the stencil sheet 100 passes through the rollers 106 when it is conveyed to the printing drum 105, the stencil sheet 100 is folded. Therefore, the stencil sheet is wrinkled when being wound around the printing drum after being stretched. Further, a conveying path of the stencil sheet 100 is made of metal plates, and this causes another problem that the stencil sheet 100 sticks to the metal plates by the static electricity, so that the conveyance of the stencil sheet is intercepted.

The object of the present invention is to solve the problems of the static electricity charged on the stencil sheet in the stencil printing machine in which the stencil sheet is perforated by the thermal head and the platen roller.

SUMMARY OF THE INVENTION

A stencil printing machine according to a first aspect of the invention comprises a thermal head for perforating a stencil sheet; a platen roller situated adjacent to the thermal head, the platen roller conveying the stencil sheet in a predetermined direction while holding the stencil sheet in contact with the thermal head; a printing drum situated near the thermal head and the platen roller, the printing drum being adapted to receive said stencil sheet perforated by the thermal head and the platen roller; and a discharging member situated near the platen roller on a downstream side of the predetermined direction relative to the thermal head and the platen roller, the discharging member discharging static electricity charged on the stencil sheet.

In a stencil printing machine according to a second aspect of the present invention, the stencil printing machine is formed according to the first aspect, wherein the discharging member is situated to contact one surface of the stencil sheet, the one surface contacting the platen roller.

In a stencil printing machine according to a third aspect of the present invention, the stencil printing machine is formed according to the first aspect, wherein the discharging member is situated to contact one surface of the stencil sheet, the one surface contacting the thermal head.

In a stencil printing machine according to a fourth aspect of the present invention, the stencil printing machine is formed according to the first aspect, wherein the stencil printing machine further comprises a storing section situated between the printing drum and both of the thermal head and the platen roller, the storing section temporarily storing the stencil sheet perforated by the thermal head and the platen roller.

In a stencil printing machine according to a fifth aspect of the present invention, the stencil printing machine is formed according to the fourth aspect, wherein the discharging member is situated to an entrance of the storing section.

DETAILED DESCRIPTION OF PREFERRED EMBODIMENTS

Figure 1:
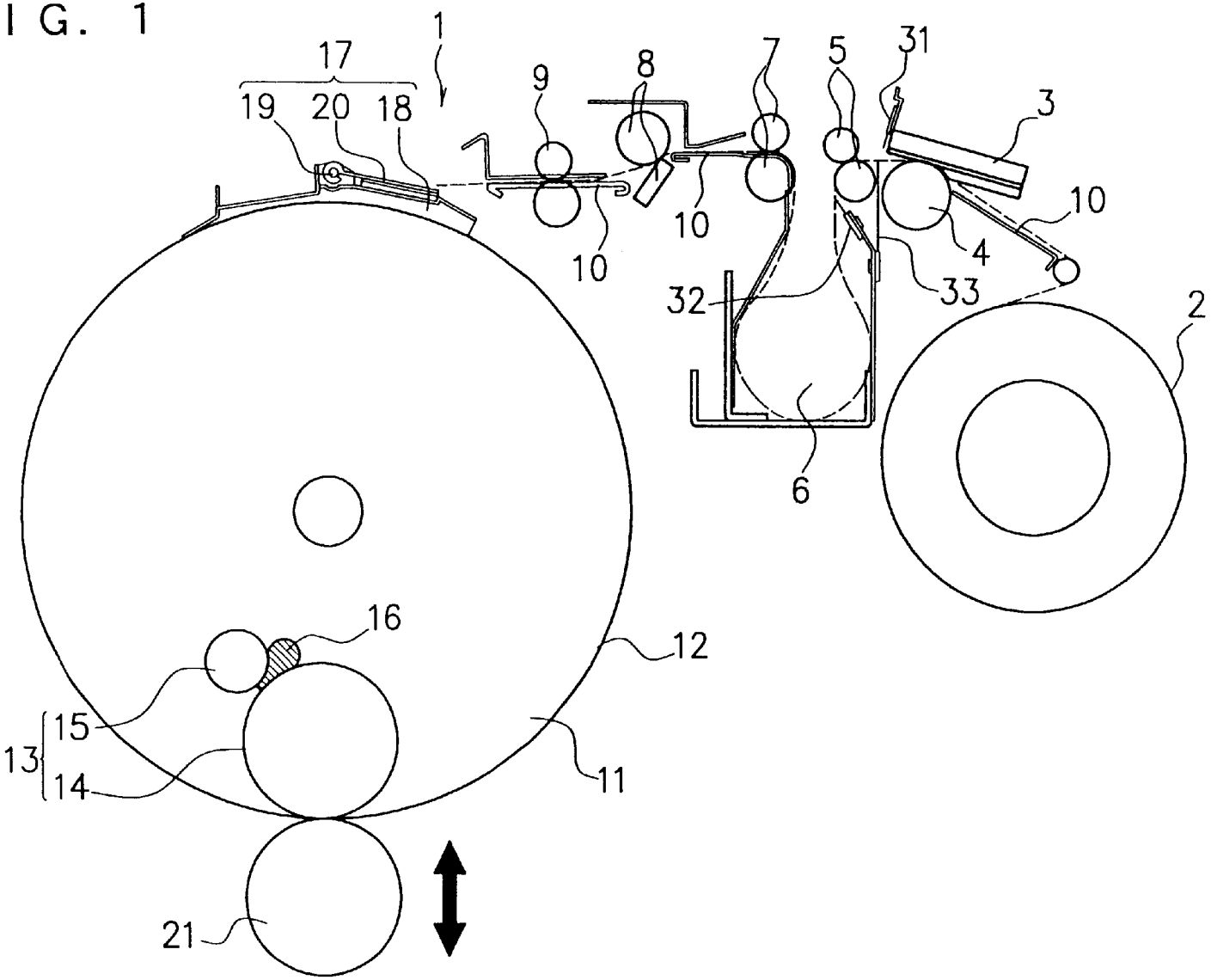
FIG. 1 is a sectional view showing an embodiment of the present invention.
Figure 2:
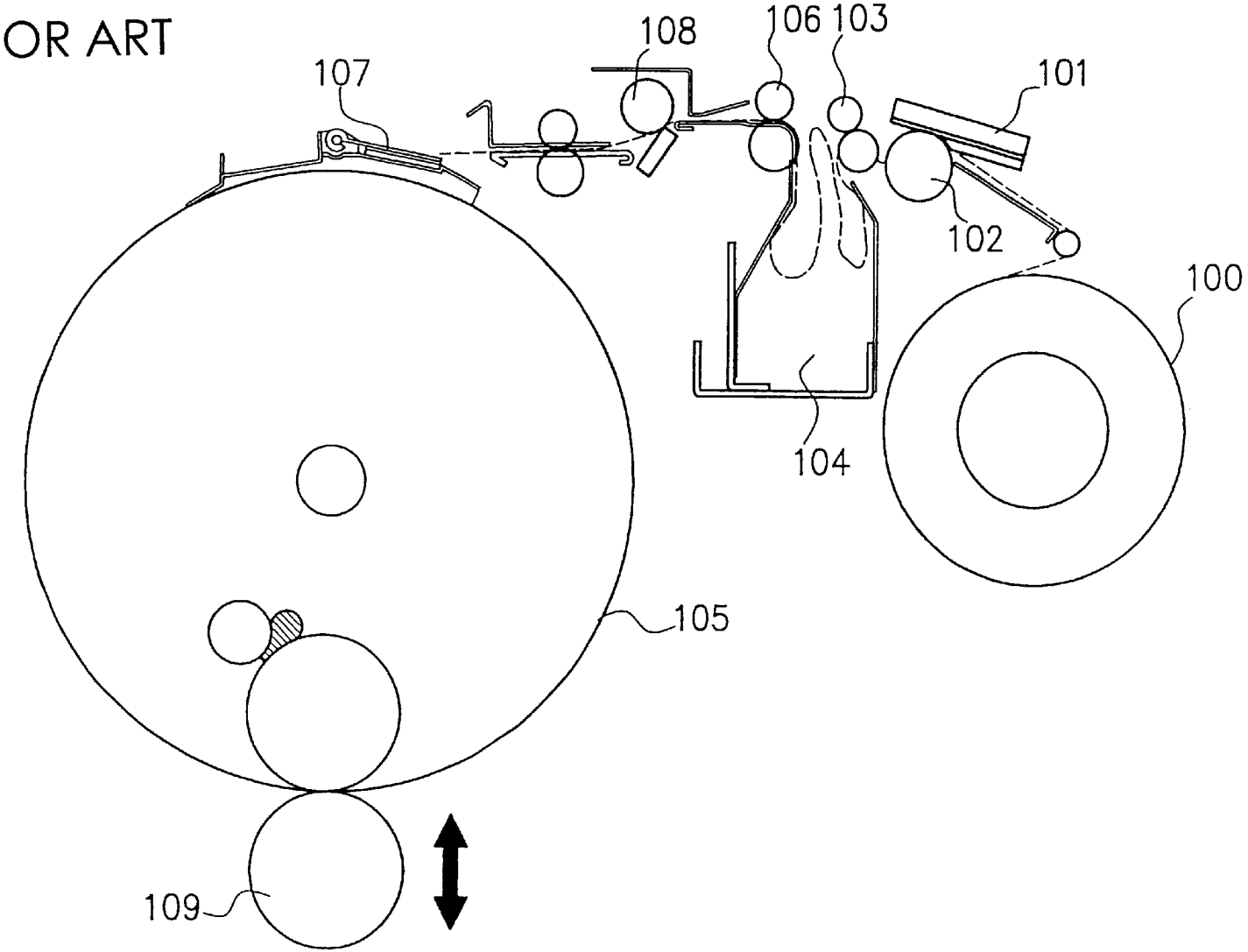
FIG. 2 PRIOR ART
FIG. 2 is a sectional view showing the conventional stencil printing machine and the problem thereof.

A stencil printing machine 1 as one embodiment of the present invention will be explained referring to FIG. 1. Firstly, a basic structure of the stencil printing machine 1 will be sequentially explained in order of a conveying direction of the stencil sheet.

The stencil sheet 2 in a roll is rotatably supported by a not-shown supporting device. Adjacent to the roll of the stencil sheet, a thermal head 3 and a platen roller 4 are situated to an upper and lower sides, respectively. The thermal head 3 contacts the platen roller 4 with a predetermined pressure in a predetermined position. The thermal head 3 and the platen roller 4 perforate the stencil sheet 2 while pinching and conveying it. Convey-in rollers 5 are situated near the thermal head 3 and the platen roller 4. The convey-in rollers 5 convey the perforated stencil sheet 2 into a storing section 6. The storing section 6 is a box with an opened upper side and situated below the convey-in rollers 5. Convey-out rollers 7 are situated opposite to the convey-in rollers 5 relative to the storing section 6. The conveyout rollers 7 convey the stencil sheet 2 in the storing section 6 outside. A cutter 8 is situated near the convey-out rollers 7. The cutter 8 cuts the stencil sheet in an appropriate length. Conveying rollers 9 are situated adjacent to the cutter 8. A conveying path 10 is composed of metal plates between the conveying rollers 9 and both of the thermal head 3 and the platen roller 4.

A printing drum 11 is rotatably situated near the conveying rollers 9. The printing drum 11 has an ink-permeable printing plate 12. The printing drum 11 is driven by a not-shown motor to rotate around a central axis thereof in an anti-clockwise direction in the figure. Ink applying means 13 is situated inside the printing drum 11. The ink supplying means 13 includes a squeegee roller 14 contacting an inner circumferential surface of the printing plate 12, a doctor roller 15 situated adjacent to the squeegee roller 14, and a not-shown ink supplying pipe for supplying ink 16 between the squeegee roller 14 and the doctor roller 15.

Clamping means 17 for holding the stencil sheet 2 is attached to an outer circumferential surface of the printing plate 12 of the printing drum 11. The clamping means 17 includes a base plate 18 attached to the outer circumferential surface of the printing plate 12 along an axial direction of the printing plate 12. On the base plate 18, a rotational axis 19 is situated parallel to an axis of the printing plate 12. A clamp plate 20 is attached to the rotational axis 19. The rotational axis 19 is rotated by not-shown driving means, thereby moving the clamp plate 20 pivotally, so that a leading end of the stencil sheet 2 is held between the clamp plate 20 and the base plate 18.

A pressing roller 21 is vertically movably situated below the printing drum 11. The pressing roller 21 pinches a printing sheet against the printing drum 11 when being moved upward, so that the printing sheet is pressed against the stencil sheet 2 on the printing drum 11.

The stencil sheet 2 in the roll is rolled out and perforated by the thermal head 3 and the platen roller 4 while being pinched therebetween and conveyed by them. And, then the stencil sheet 2 is fed into the storing section 6 to be stored there. While a used stencil sheet wound around the printing drum 11 is being discharged, the stencil sheet 2 in a length to be used for one printing-operation is previously perforated and stored in the storing section 6. The stencil sheet 2 is positioned in the conveying path 10 in such a manner that the leading end thereof protrudes from the cutter 8. Then, the stencil sheet 2 is fed out by the convey-out rollers 7 in a predetermined timing and conveyed to the printing drum 11. The stencil sheet 2 is wound around the circumferential surface of the printing drum 11 by rotating the same after being held by the clamp plate 20 of the printing drum 11 at the leading end thereof. And, then the stencil sheet 2 is cut by the cutter 8 in the length for one printing-operation. Afterwards, the printing sheet is supplied between the printing drum 11 and the pressing roller 21 in synchronization with rotation of the printing drum 11 and upward movement of the pressing roller 21. The printing sheet is printed while being pinched and conveyed by the printing drum and the pressing roller.

Next, the present stencil printing machine 1 includes three discharging brushes as discharging members for discharging the static electricity charged on the stencil sheet 2 that is conveyed and perforated by the thermal head 3 and the platen roller 4. The discharging brush is constituted such that many thin stainless wires are bundled. Another example of the discharging member may be a discharging cloth with copper wire woven therein or a discharging cloth coated with a conductive material.

A first discharging brush 31 is situated adjacent to the thermal head 3 on a downstream side of the conveying direction of the stencil sheet 2 relative to the thermal head 3 and the platen roller 4. That is, the first discharging brush 31 is arranged downward on the thermal head 3 side and situated adjacent to one surface of the stencil sheet 2, the surface of the thermoplastic resin film, contacting the thermal head 3. The first discharging brush 31 is fixed to a metal plate to which the thermal head 3 is attached. The metal plate is earthed.

A second discharging brush 32 is attached to an entrance of the storing section 6. The second discharging brush 32 is situated below the convey-in rollers 5 and contacts the lower surface of the stencil sheet 2, the surface of the porous substrate.

A third discharging brush 33 is situated adjacent to the platen roller 4 on the downstream side of the conveying direction of the stencil sheet 2 relative to the thermal head 3 and the platen roller 4. That is, the third discharging brush 33 is arranged upward on the platen roller 4 side and situated adjacent to the other surface of the stencil sheet 2, the surface of the porous substrate, contacting the platen roller 4. The third discharging brush 33 is fixed to the storing section 6 similarly to the second discharging brush 32. The storing section 6 is earthed.

These discharging brushes 31, 32 and 33 discharge the static electricity charged on the stencil sheet 2. In order to discharge the static electricity charged on the stencil sheet 2, the discharging brushes 31, 32, and 33 may or may not contact the stencil sheet 2. However, the discharging brushes cannot exhibit electric-discharging ability if an electric conductor is situated at the opposite side of the brushes relative to the stencil sheet 2. Accordingly, similarly to the discharging brushes 31, 32, and 33, it is desirable to select appropriate positions where the electric conductors do not exist on opposite sides thereof relative to the stencil sheet 2 and to situate the discharging members thereto.

The three discharging brushes 31, 32, and 33 surely discharge the static electricity of the stencil sheet 2 as passed through the thermal head 3 and the platen roller 4. Therefore, the perforated stencil sheet 2 does not stick to the platen roller 4 and the conveying path 10, nor distort in the twisting way in the storing section 6.

Additionally, the third discharging brush 33 can serve as structural means of preventing the stencil sheet 2 from curling round the platen roller 4 since the brush 33 is arranged upward adjacent to the platen roller 4 situated below the stencil sheet 2. That is, even in the case where the stencil sheet 2 tends to curl round the platen roller 4, the stencil sheet 2 cannot behave such way since it is supported by the third discharging brush situated adjacent to the platen roller 4.

Although the stencil printing machine 1 as explained above includes three discharging brushes 31, 32, and 33, a certain extent of effect can be achieved only by the second and the third discharging brushes 32 and 33, and also the third discharging brush 33 can function to a certain extent alone.

Further, if the stencil printing machine does not have the storing section 6, the second discharging brush 32 can be omitted. In such a case, both of the first and the third discharging brushes 31 and 33 may be adopted, or only the third discharging brush 33 may be adopted.

Further, if the stencil printing machine has the storing section 6 but not the convey-in rollers 5, it is preferable to adopt all of the three discharging brushes 31, 32, and 33 similarly to the embodiment.

According to the stencil printing machine of the present invention, the discharging member is situated on the downstream side of the conveying direction of the stencil sheet relative to the thermal head and the platen roller, thereby discharging the static electricity charged on the stencil sheet during perforating. This eliminates sticking of the stencil sheet to itself and the machine by the static electricity, so that the stencil sheet can be conveyed smoothly and the problem of the wrinkled stencil sheet is solved.

What is claimed is:

1. A stencil printing machine comprising:

a thermal head for perforating a stencil sheet;

a platen roller situated adjacent to the thermal head, said platen roller being adapted to convey the stencil sheet in a predetermined direction while holding the stencil sheet to contact the thermal head;

a printing drum situated near the thermal head and the platen roller, said printing drum being adapted to receive the stencil sheet perforated by the thermal head; and a discharging member situated near the platen roller to be spaced apart therefrom on a downstream side of a moving direction of the stencil sheet, said discharging member being disposed on a side of the platen roller and directed to the stencil sheet so that the discharging member is adapted to contact a lower side of the stencil sheet passing between the thermal head and the platen roller, said discharging member configured to support the stencil sheet to prevent the stencil sheet from curling around the platen roller and to discharge static electricity charged on the stencil sheet.

2. A stencil printing machine according to claim 1, wherein said discharging member is located at a position such that an electric conductor is not disposed at a side opposite to the discharging member relative to the stencil sheet.

3. A stencil printing machine according to claim 2, further comprising a storing section situated between the printing drum and the platen roller for temporarily storing the stencil sheet perforated by the thermal head, said discharging member being attached to the storing section.

4. A stencil printing machine according to claim 3, further comprising another discharging member formed near the thermal head at a side opposite to the discharging member near the platen roller, said another discharging member adapted to contact the stencil sheet on an upper side of the stencil sheet adjacent the thermal head, a roller situated between the platen roller and the storing section for introducing the stencil sheet to the storing section, and a further discharging member attached to the storing section and adapted to contact the stencil sheet between the roller and the storing section.

5. A stencil printing machine according to claim 4, wherein each of the discharging members is a brush for contacting the stencil sheet.

* * * * *